United States Patent [19]

Saulnier

[11] Patent Number: 5,060,480

[45] Date of Patent: Oct. 29, 1991

[54] PROCESS AND APPARATUS FOR THE LIQUEFACTION OF A FLOW OF GASEOUS OXYGEN

[75] Inventor: Bernard Saulnier, Colombes, France

[73] Assignee: L'Air Liquide, Societe Anonyme Pour L'Etude et L'Exploitation Des Procedes Georges Claude, Paris, France

[21] Appl. No.: 605,496

[22] Filed: Oct. 30, 1990

[51] Int. Cl.[5] ..... F25J 1/00

[52] U.S. Cl. ..... 62/9; 62/38; 62/50.2; 62/86

[58] Field of Search ..... 62/9, 11, 50.2, 38, 62/39, 86

[56] References Cited

U.S. PATENT DOCUMENTS

| | | | |
|---|---|---|---|
| 2,909,906 | 10/1959 | Bocquet et al. | 62/50.2 |
| 2,960,834 | 11/1960 | Kirk Patrick | 62/7 |
| 3,058,315 | 10/1962 | Schuftan | 62/50.2 |
| 3,397,548 | 8/1968 | Ergenc | 62/50.2 |

*Primary Examiner*—Ronald C. Capossela

*Attorney, Agent, or Firm*—Curtis, Morris & Safford

[57] ABSTRACT

Gaseous oxygen to be cooled passes through an exchanger which is cooled with compressed liquid nitrogen, at least a portion of the vaporized nitrogen which is warmed up in the exchanger being treated in a turbine and thereafter reintroduced into the exchanger. Application for example to the storage in liquid form of excess oxygen under pressure conveyed by a distribution network with variable load.

15 Claims, 3 Drawing Sheets

PROCESS AND APPARATUS FOR THE LIQUEFACTION OF A FLOW OF GASEOUS OXYGEN

OF INVENTION (a) Field of the Invention

The present invention concerns a process and an apparatus for the liquefaction of a flow of gaseous oxygen under pressure. It is more particularly adapted to the storage in liquid form of an excess of gaseous oxygen from a network for the distribution of oxygen under pressure with variable load or for the production of a liquefaction unit adjacent an existing unit for air distillation initially designed to produce oxygen only under gaseous form.

(b) Description of Prior Art

There are a certain number of situations where a distribution network or an air distillation unit happens to produce oxygen in excess and it is not possible or desirable to correspondingly reduce the flow of gaseous oxygen produced. This is particularly the case of an oxygen distribution network in which the load varies so fast that it is not of interest to adapt the flow of air treated by the distillation apparatus since the frequency of change in the operating conditions would lead to losses of argon and/or energy.

SUMMARY OF INVENTION

The present invention aims at providing a process and an apparatus for the liquefaction of an excess of available gaseous oxygen which requires only a reduced quantity of liquid nitrogen to carry out this liquefaction.

According to the process of the invention, gaseous oxygen is passed through a first line which extends across a heat exchanger, liquid nitrogen is pumped into a container and liquid nitrogen is passed under pressure through a second line which extends across the exchanger, at least a portion of the nitrogen which has been vaporized and warmed up at a first temperature is withdrawn from the first line of the exchanger, the nitrogen thus withdrawn is expanded in a first turbine, the nitrogen expanded in the first turbine is recirculated through a third line extending across the exchanger and liquid oxygen which exits from the first line is stored in a container.

The apparatus for liquefaction according to the invention comprises an exchanger having a hot end and a cold end and including a first and a second crossing lines, means to connect the hot end of the first line to the oxygen distribution network, means to connect the cold line to a liquid oxygen storage container, a container for liquid nitrogen, a circuit portion including a pump and connecting the liquid nitrogen container to the cold end of the second line, a first nitrogen circuit, including a first turbine, starting from an intermediate point of the second line and reaching, at one point near the cold end of the exchanger, a third line extending across the exchanger to the hot end.

BRIEF DESCRIPTION OF DRAWINGS

Some embodiments of the invention will now be described with respect to the annexed drawings, in which.

DESCRIPTION OF PREFERRED EMBODIMENTS

Figure 1:
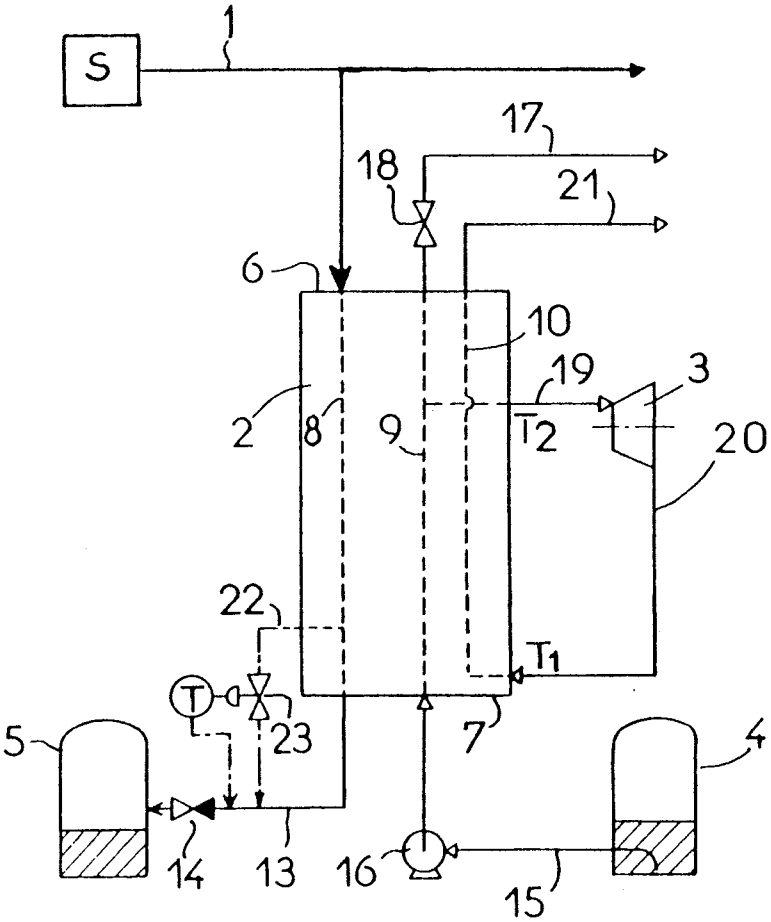
FIG. 1 is a schematic representation of a first embodiment of an apparatus according to the invention.

The apparatus illustrated in FIG. 1 is intended to liquefy a flow of gaseous oxygen under pressure which is conveyed by a duct 1 and originates from a source S of gaseous oxygen, for example, an air distillation unit. The apparatus essentially comprises a heat exchanger 2 of the counter-current type, an expansion turbine 3, a liquid nitrogen storage container 4 and a liquid oxygen storage container 5, these two containers being substantially at atmospheric pressure.

The exchanger 2 includes a hot end 6, substantially at room temperature and a cold end 7. The exchanger comprises a first line 8 for cooling oxygen which extends from the hot end to the cold end, a second line 9 for warming up high pressure nitrogen, extending from the cold end to the hot end, and a third line 10 for warming up low pressure nitrogen extending from an intermediate point of the exchanger near the cold end, corresponding to temperature $T_1$, to the hot end.

The inlet of line 8 is connected to duct 1 and its outlet is connected to container 5 by means of a duct 13 provided with an expansion valve 14. The bottom of the container 4 is connected to the cold end of line 9 by means of a duct 15 provided with a pump 16, the outlet, at the hot end of line 9 being connected to a duct 7 for withdrawing or utilizing gaseous nitrogen, which is provided with valve 18.

The inlet of turbine 3 is connected by means of a duct 19 to line 9, at an intermediate point of the latter corresponding to an intermediate temperature $T_2$ higher than $T_1$, and its outlet is connected to the input of line 10 by means of a duct 21.

The oxygen from duct 1, presumed at room temperature and a pressure substantially constant of about 12 bar, is cooled, liquefied then sub-cooled in line 8, the liquid which is conveyed by the recovering duct 13, after expansion in a valve 14 at a pressure slightly higher than 1 bar, is collected in container 5.

To ensure the cooling of oxygen, liquid nitrogen is pumped at about 11 bar by means of pump 16, the flow of liquid nitrogen being adjusted as a function of the flow of oxygen to be liquified. Liquid nitrogen is vaporized and warmed up in line 9. At temperature $T_2$, of the order of $-135°$ C., at least a portion of the high pressure nitrogen is bypassed in duct 19, expanded at a pressure of the order of 1 bar in turbine 3, reintroduced into line 10 at temperature $T_1$, of the order of $-195°$ C., and warmed up again up to room temperature in line 10 to be withdrawn via duct 21.

Figure 2:
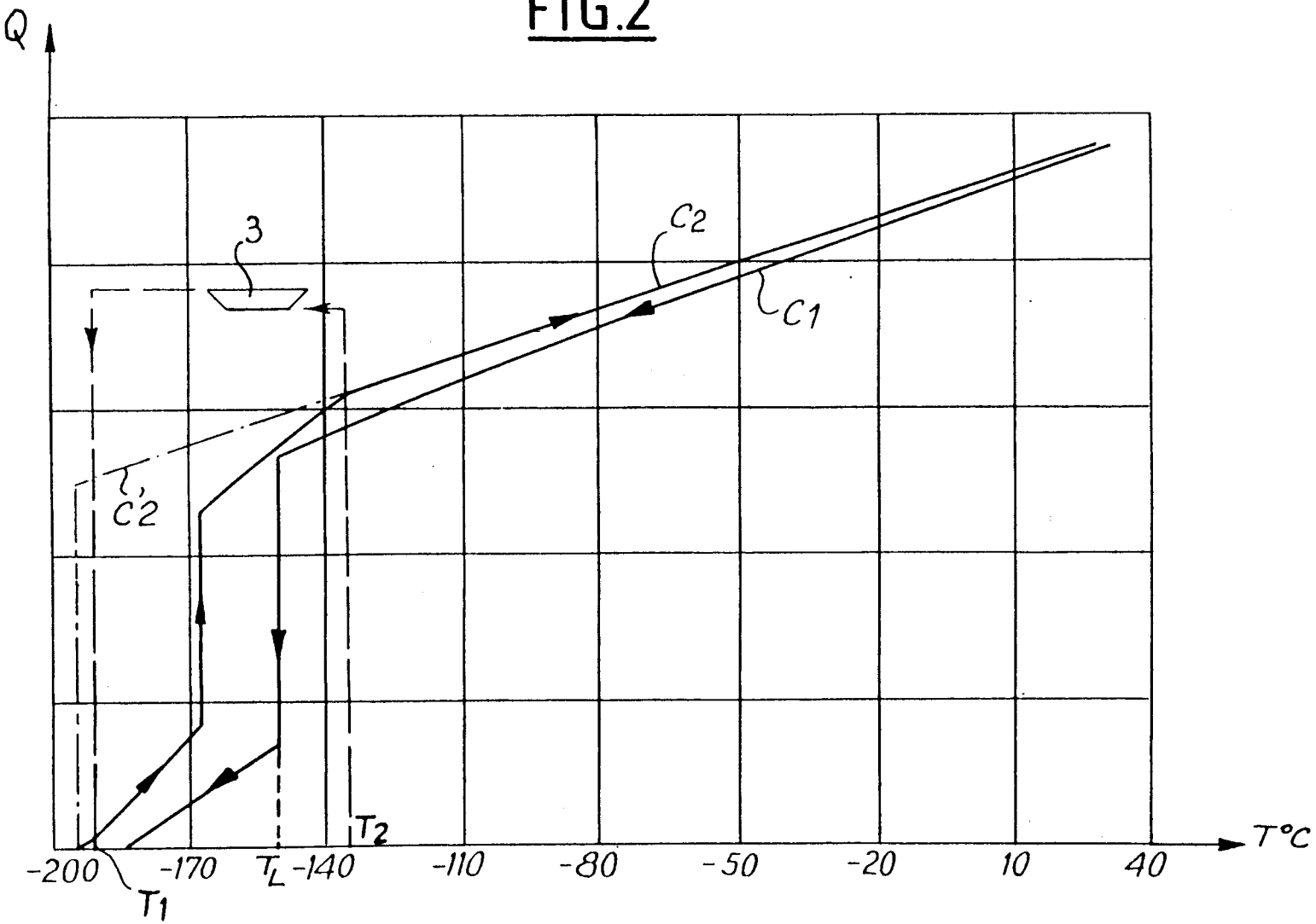
FIG. 2 is a heat exchange diagram concerning this apparatus.

There is thus produced an additional cold input in a range of temperatures higher than $T_1$. If the entire high pressure nitrogen is turbined in turbine 3, the heat exchange diagram represented in FIG. 2 is obtained where temperature T is shown in abscissae and the quantities of heat Q effectively exchanged by the fluid being warmed up (nitrogen) and by the fluid being cooled (oxygen) is shown in oridnates. Thus, curve $C_1$ corresponds to the cooling of oxygen and curve $C_2$ which should always remain above the previous one, corresponds to the warming up of high pressure and low pressure nitrogen.

As shown in FIG. 2, the warming curve for nitrogen, from $T_1$ to $T_2$, before and after the liquefaction plateau, shows an increasing slope, and this appears in a temperature zone which borders the liquefaction temperature TL of oxygen. It will be seen that because of the turbine 3, and in view of the expansion rate of the latter, nitrogen can be vaporized at a temperature higher than the −170° C., corresponding to the above pressure of about 11 bar, to thereafter give a much closer heat exchange diagram in its cold portion than in the case where no turbine would be used. As a matter of fact, in this case, in order that curve $C'_2$ be located above curve $C_1$, nitrogen should be vaporized under a much lower pressure, as indicated in mixed line in FIG. 2.

For example it will be observed that if a portion of the vaporized nitrogen is not treated in a turbine, the apparatus enables to produce, in duct 7, gaseous nitrogen under pressure without using compression energy.

Figure 3:
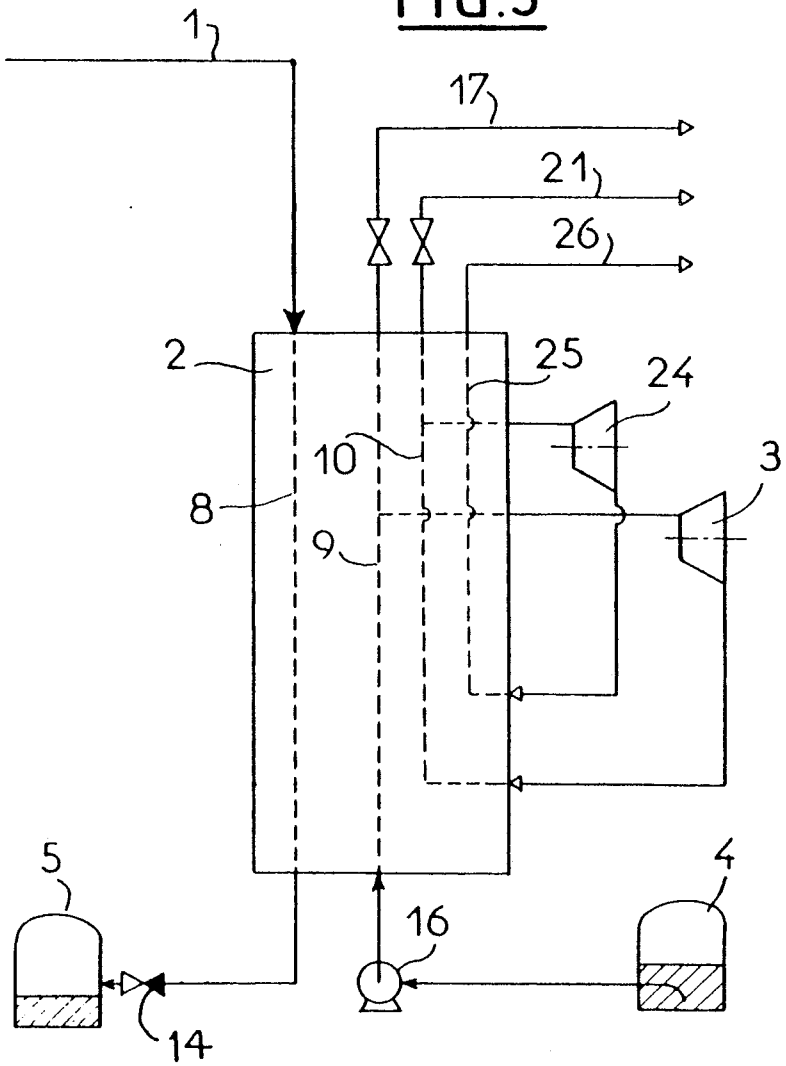
FIGS. 3, 4 and 5 are views similar to FIG. 1 corresponding to three other embodiments of an apparatus according to the invention.

In the embodiment of FIG. 3, turbine 3 expands nitrogen only at a mean pressure, and the mean pressure nitrogen is, at least partially, expanded in a second turbine 24 to about atmospheric pressure, then warmed up in line 25 extending from an intermediate point of the exchanger to the cold end of the latter which is connected to an exhaust duct 26.

Figure 4:
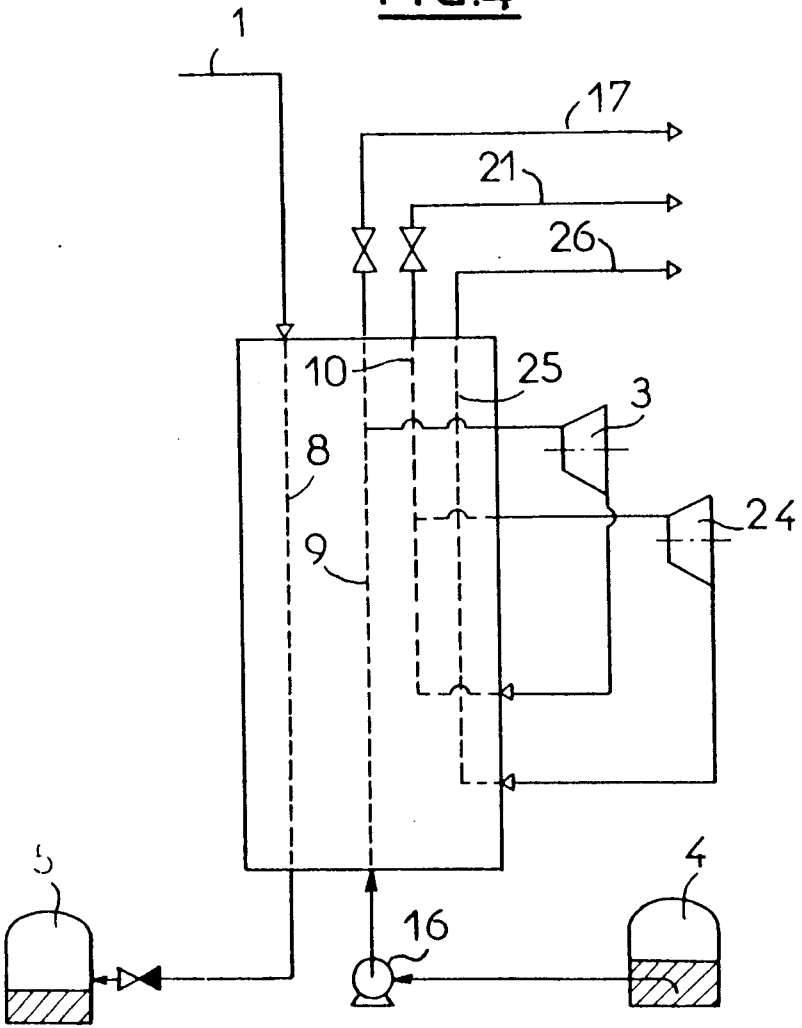

While in the embodiment of FIG. 3, the inlet temperature of the high pressure turbine 3 is lower than that of the low pressure turbine 24, the reverse is obtained in the embodiment of FIG. 4. This variant brings about certain advantages on a thermodynamic aspect, as described in French Patent application FR 89.12517 in the name of the Applicant, the content of which is incorporated herein by reference.

Figure 5:
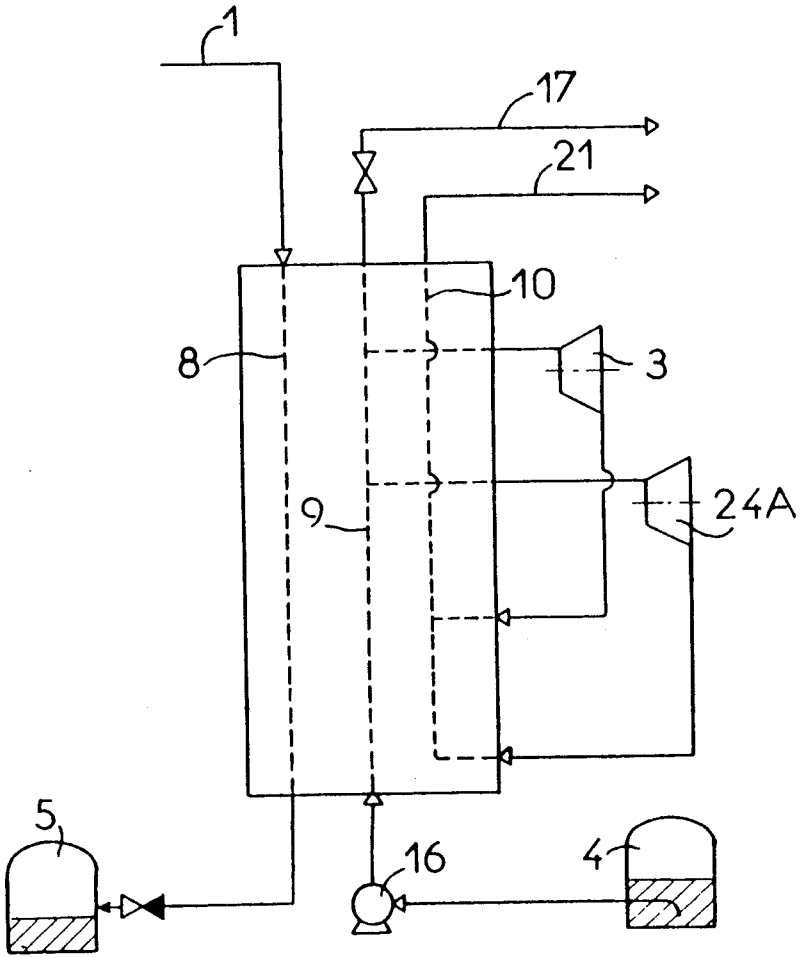

In the embodiment of FIG. 5, the two turbines are not in series but in parallel: with respect to the embodiment of FIG. 1, a second turbine 24A has been added here, which is connected between line 9 and line 10 at intermediate points of the latter corresponding to temperature ranges higher than temperature $T_1$ and $T_2$, respectively.

For a given pressure used for pumping liquid nitrogen, the process according to the invention enables to produce some variation of the pressure of oxygen that is liquefied. This pressure is limited in the lower range by the necessity to always maintain curve $C_1$ (FIG. 2) below curve $C_2$ and, toward the upper range, by economical considerations, for example, because of the differentiation of the heat exchange diagram in the cold portion thereof. By way of numerical example, with a substantially constant pressure of liquid nitrogen of 11 bar, it is possible to accept in line 8 a pressure of oxygen which varies between about 12 and 30 bar.

As a variant, if the pressure of oxygen varies beyond the above mentioned range, it is also possible to ensure that the pumping pressure for liquid nitrogen be adjusted as a function of the pressure of oxygen, at least outside this range, so as to maintain a heat exchange diagram similar to that represented in FIG. 2.

When the pressure of oxygen in duct 1 varies substantially, it may be advantageous, as represented in mixed line of FIG. 1, to ensure a slight overpressure in storage container 5, to provide a bypass 22 connecting a point of the cold part of line 8 to duct 13, upstream of the valve 14, which bypass is provided with a valve 23 governed by the temperature of oxygen at the inlet of valve 14.

According to another variation, the pressure of oxygen which is introduced into line 8 may be made constant by providing the connecting duct of this line 8 to duct 1 with an expansion valve (not illustrated).

In all cases, if the pumping pressure of nitrogen should exceed the permissible rate of expansion for a turbine, an apparatus provided with two turbines mounted in series can be used, such as those represented in FIGS. 3 or 4.

We claim:

1. Process for the liquefaction of a flow of gaseous oxygen under pressure, which comprises the following steps:
   - passing gaseous oxygen, in one direction, through a first line which extends across a heat exchanger;
   - passing a counter-current flow of liquid nitrogen under pressure through a second line which extends across the exchanger;
   - withdrawing at least a portion of the nitrogen which has been vaporized and warmed up at a first temperature in the second line;
   - expanding nitrogen withdrawn from the second line, in a first turbine;
   - recirculating through a third line of the exchanger a counter-current flow of nitrogen expanded in the first turbine; and
   - collecting liquid oxygen which exits from the first line.

2. Process according to claim 1, comprising the steps of:
   - withdrawing from the third line at least a portion of the nitrogen which has been vaporized and warmed up at a second temperature;
   - expanding this nitrogen withdrawn from the third line into a second turbine;
   - counter-currently recirculating the nitrogen expanded in the second turbine into a fourth line of the exchanger.

3. Process according to claim 2, in which the second temperature is lower than the first temperature.

4. Process according to claim 2, in which the second temperature is higher than the first temperature.

5. Process according to claim 1, comprising the steps of:
   - withdrawing from the second line a portion of the nitrogen which has been vaporized and warmed up at a third temperature;
   - expanding this withdrawn nitrogen into a second turbine;
   - counter-currently recirculating in the third line, the nitrogen which has been expanded in the second turbine.

6. Process according to claim 5, in which the third temperature is lower than the first temperature.

7. Process for the storage in liquid form of gaseous oxygen which is available in excess in a distribution network, comprising the following steps:
   - passing gaseous oxygen, in one direction, through a first line which extends across a heat exchanger;
   - pumping liquid nitrogen into a liquid container and passing said liquid nitrogen in a second line which extends across the exchanger;
   - expanding nitrogen withdrawn from the second line, in a first turbine;
   - recirculating through a third line extending through the exchanger the nitrogen expanded in the first turbine; and
   - storing the liquid oxygen which exits from the first line, in a container.

8. Process according to claim 7, comprising the step of distributing gaseous nitrogen which exits from the second line.

9. Process according to claim 7, comprising the steps of:

withdrawing from the third line at least a portion of the nitrogen which has been vaporized and warmed up at a second temperature;

expanding said nitrogen withdrawn from the third line in a second turbine;

recirculating in a fourth line of the exchanger the nitrogen expanded in the second turbine.

10. Process according to claim 9, in which the second temperature is lower than the first temperature.

11. Process according to claim 9, in which the second temperature is higher than the first temperature.

12. Apparatus for liquefying gaseous oxygen which is available in excess in an oxygen distribution network comprising an exchanger having a hot end and a cold end and including a first and a second line extending across said exchanger;

means to connect the hot end of the first line through the distribution network;

means to connect the cold end of the first line to a liquid oxygen storage container;

a liquid nitrogen container;

part of the circuit incorporating a pump and connecting the liquid nitrogen container to the cold end of the second line;

a first nitrogen circuit, incorporating a first turbine, extending from an intermediate point of the second line and connecting, at a point near the cold end of the exchanger, a third line extending into the exchanger to the hot end.

13. Apparatus according to claim 12, comprising a second nitrogen circuit, incorporating a second turbine, extending from an intermediate point of the third line and reaching in an intermediate zone of the exchanger, a fourth line extending in the exchanger to the hot end thereof.

14. Apparatus according to claim 13, in which the intermediate point of the third line is closer to the hot end of the exchanger than the intermediate point of the second line.

15. Apparatus according to claim 13, in which the intermediate point of the third line is more remote from the hot end of the exchanger than the intermediate point of the second line.

* * * * *

UNITED STATES PATENT AND TRADEMARK OFFICE

CERTIFICATE OF CORRECTION

PATENT NO. : 5,060,480

DATED : October 29, 1991

INVENTOR(S) : Bernard Saulnier

It is certified that error appears in the above-identified patent and that said Letters Patent is hereby corrected as shown below:

Claim 7, column 4, after line 61 insert the following subparagraph:

--withdrawing from the second line at least a portion of the nitrogen which has been vaporized and warmed up at a first temperature;--.

Signed and Sealed this

Twenty-third Day of February, 1993

*Attest:*

STEPHEN G. KUNIN

*Attesting Officer*

*Acting Commissioner of Patents and Trademarks*